US010927804B2

(12) United States Patent
Yi et al.

(10) Patent No.: US 10,927,804 B2
(45) Date of Patent: Feb. 23, 2021

(54) DIRECT FUEL INJECTOR

(71) Applicant: Ford Global Technologies, LLC, Dearborn, MI (US)

(72) Inventors: Jianwen James Yi, West Bloomfield, MI (US); Foo Chern Ting, Canton, MI (US); Xinlei Zhou, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 255 days.

(21) Appl. No.: 15/616,805

(22) Filed: Jun. 7, 2017

(65) Prior Publication Data

US 2018/0355832 A1 Dec. 13, 2018

(51) Int. Cl.
*F02M 61/18* (2006.01)

(52) U.S. Cl.
CPC ..... *F02M 61/1813* (2013.01); *F02M 61/184* (2013.01); *F02M 61/1846* (2013.01)

(58) Field of Classification Search
CPC ..... F02M 61/1813; F02M 61/182; F02M 61/184; F02M 61/1846; F02B 23/0669; F02B 2023/103
See application file for complete search history.

(56) References Cited

U.S. PATENT DOCUMENTS 5,707,012 A 1/1998 Maier et al.
5,785,254 A 7/1998 Zimmermann et al.
6,050,507 A * 4/2000 Holzgrefe ..... F02M 51/0671 239/585.1
6,092,743 A 7/2000 Shibata et al.
6,708,907 B2 3/2004 Fochtman et al.
7,909,271 B2 * 3/2011 Cavanagh ..... F02M 61/1826 123/299
9,194,351 B2 11/2015 Albrodt et al.
9,518,547 B2 * 12/2016 John ..... F02M 61/14
10,047,714 B2 * 8/2018 Kobayashi ..... F02M 61/1806
2004/0056113 A1 3/2004 Peterson, Jr.
2005/0120995 A1 * 6/2005 Tsujimoto ..... F02B 23/0669 123/299
2005/0194458 A1 * 9/2005 Bierstaker ..... F02M 61/1853 239/5
2011/0232289 A1 9/2011 Colmegna et al.
2015/0211458 A1 7/2015 Carpenter et al.
2015/0211461 A1 7/2015 Shirk et al.
2016/0237969 A1 * 8/2016 Mifuji ..... F02M 51/0614
2016/0341165 A1 * 11/2016 Ishikawa ..... F02M 61/1813

FOREIGN PATENT DOCUMENTS

WO 9610694 A1 4/1996

* cited by examiner

*Primary Examiner* — Alex M Valvis
(74) *Attorney, Agent, or Firm* — Geoffrey Brumbaugh McCoy Russell LLP

(57) ABSTRACT

A fuel delivery system and a direct injector for directly injecting fuel into a cylinder are provided. In one example, a direct fuel injector includes a nozzle in fluidic communication with a fuel source, the nozzle includes a first set of orifices, each of the orifices in the first set arranged at a first orifice angle on an intake side of the nozzle. The direct fuel injector further includes a second set of orifices, each of the orifices in the second set arranged at a second orifice angle greater than the first orifice angle on an exhaust side of the nozzle.

20 Claims, 7 Drawing Sheets

DIRECT FUEL INJECTOR

FIELD

The present description relates generally to a direct fuel injector in a fuel delivery system of an engine.

BACKGROUND/SUMMARY

Fuel delivery systems in internal combustion engines have employed fuel injectors to deliver fuel directly into engine combustion chambers. Previous direct fuel injectors have included nozzles with a small number of orifices that provide jets of fuel to combustion chambers during desired intervals. One example approach shown by Albrodt, in U.S. Pat. No. 9,194,351, is a fuel injection valve. Albrodt discloses a fuel injection valve with a perforated disk at the end of the injector valve. The perforated disk includes outlet openings configured to spray fuel in a pattern that promotes mixing. In particular, the outlet openings arrangement in Albrodt generates swirl in the fuel spray, to increase mixing in a combustion chamber. The inventors have recognized several problems with Albrodt's fuel injection valve as well as other fuel injectors. For example, the disk in the fuel injection valve includes a small number of openings directing a portion of the fuel spray to combustion chamber walls and the piston. Therefore, engines employing Albrodt's fuel injection valve may experience wall wetting. Consequently, the fuel on the walls may not fully combust during the power stroke, thereby increasing emissions (e.g., smoke and particulate matter emissions) and reducing combustion efficiency.

The inventors have recognized the aforementioned problems and facing these problems developed a direct fuel injector, in one example. The direct fuel injector includes a nozzle in fluidic communication with a fuel source. The nozzle including a first set of orifices, each of the orifices in the first set arranged at a first orifice angle on an intake side of the nozzle. The direct fuel injector further includes a second set of orifices, each of the orifices in the second set arranged at a second orifice angle greater than the first orifice angle on an exhaust side of the nozzle. A direct fuel injector with a first set of orifices near the intake valve having a greater orifice angle than a second set of orifices near the exhaust valve enables a spray pattern to be generated that reduces fuel impingement on the cylinder walls and piston. As a result, engines employing the direct fuel injector may achieve emission reductions and combustion efficiency gains. In particular, the spray pattern generated by the fuel injector may reduce smoke and particulate matter emissions.

As one example, the first set of orifices and the second set of orifices may each be arranged in an arc about a central axis of the nozzle and have a common vertical position with regard to a vertical axis. In this way, the injector generates a fuel spray pattern with arcing jets resembling petal shapes. This spray pattern further reduces wall wetting in the cylinder. Consequently, the engine may achieve further emissions reductions and combustion efficiency gains.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

The following description relates to a direct fuel injector in a fuel delivery system of an internal combustion engine. The direct fuel injector generates a spray pattern in different arcs that decrease wall wetting. For instance, the nozzle may include different sets of orifices arranged in arcs about a central axis of the nozzle. Each of the sets of orifices may have a different theta angle (θ). Specifically, a first set of orifices adjacent to an intake valve may have a smaller theta angle (θ) than a theta angle (θ) of a second set of orifices adjacent to an exhaust valve. In this way, the fuel injector nozzle generates a spray pattern resembling a petal shape that reduces wall wetting. Specifically, the smaller nozzles and the petal shaped jets generate smaller injected fuel droplets, which have less momentum when compared to previous multi-hole injectors. The reduction in momentum limits the penetration of the spray and enhances the downstream droplet dispersion in the spray. Thus, the spray pattern may make the droplets turn back instead of continue the injection path to hit the wall. Moreover, the petal like spray pattern may also achieve a desired amount of penetration and fuel evaporation in the cylinder to enable combustion stability to be maintained while also achieving the abovementioned wall wetting reductions. Resultantly, emissions may be reduced and combustion efficiency may be increased in engines utilizing the direct fuel injector described herein.

Figure 1:
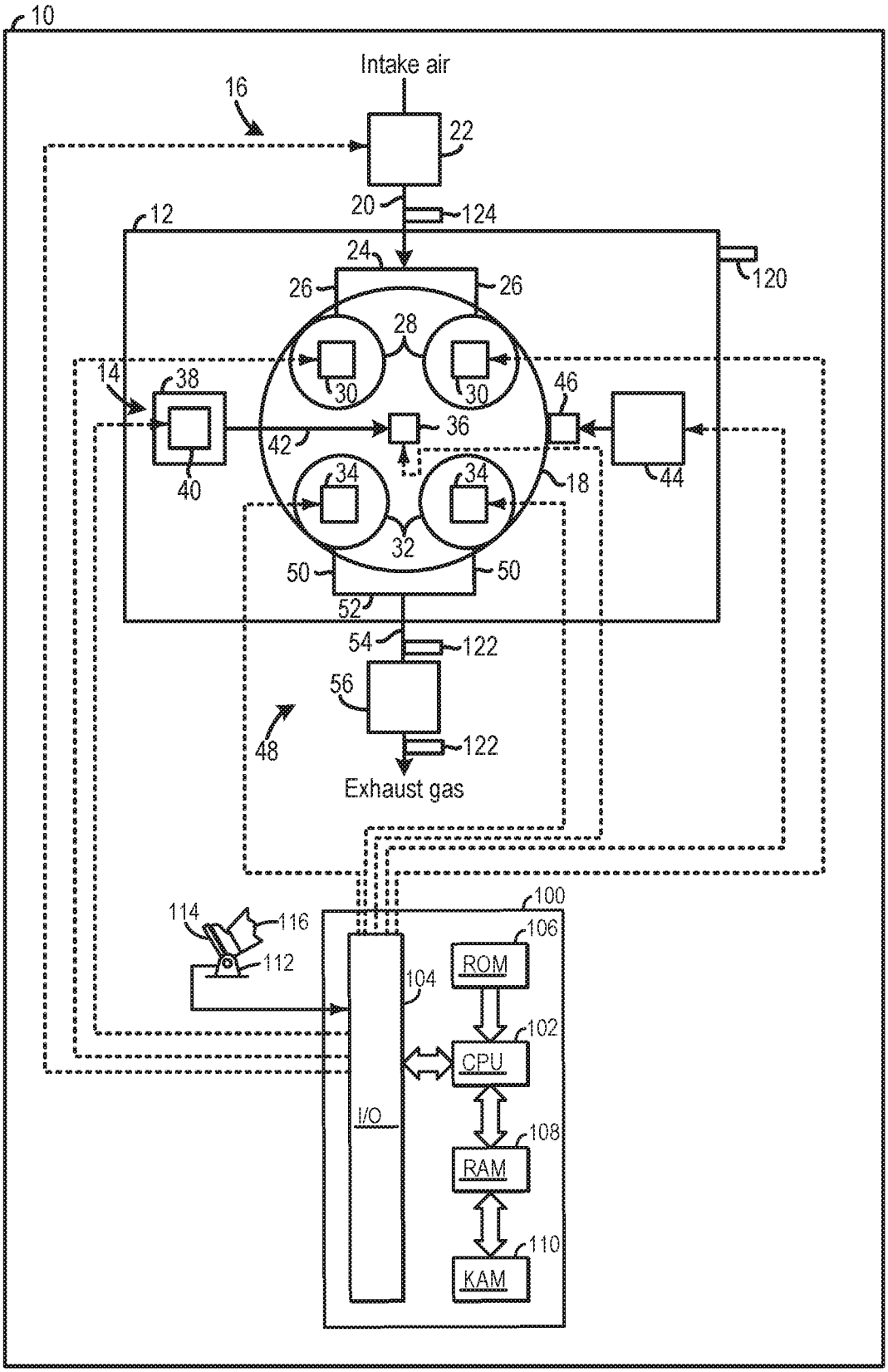
FIG. 1 shows a schematic depiction of an internal combustion engine.
Figure 2:
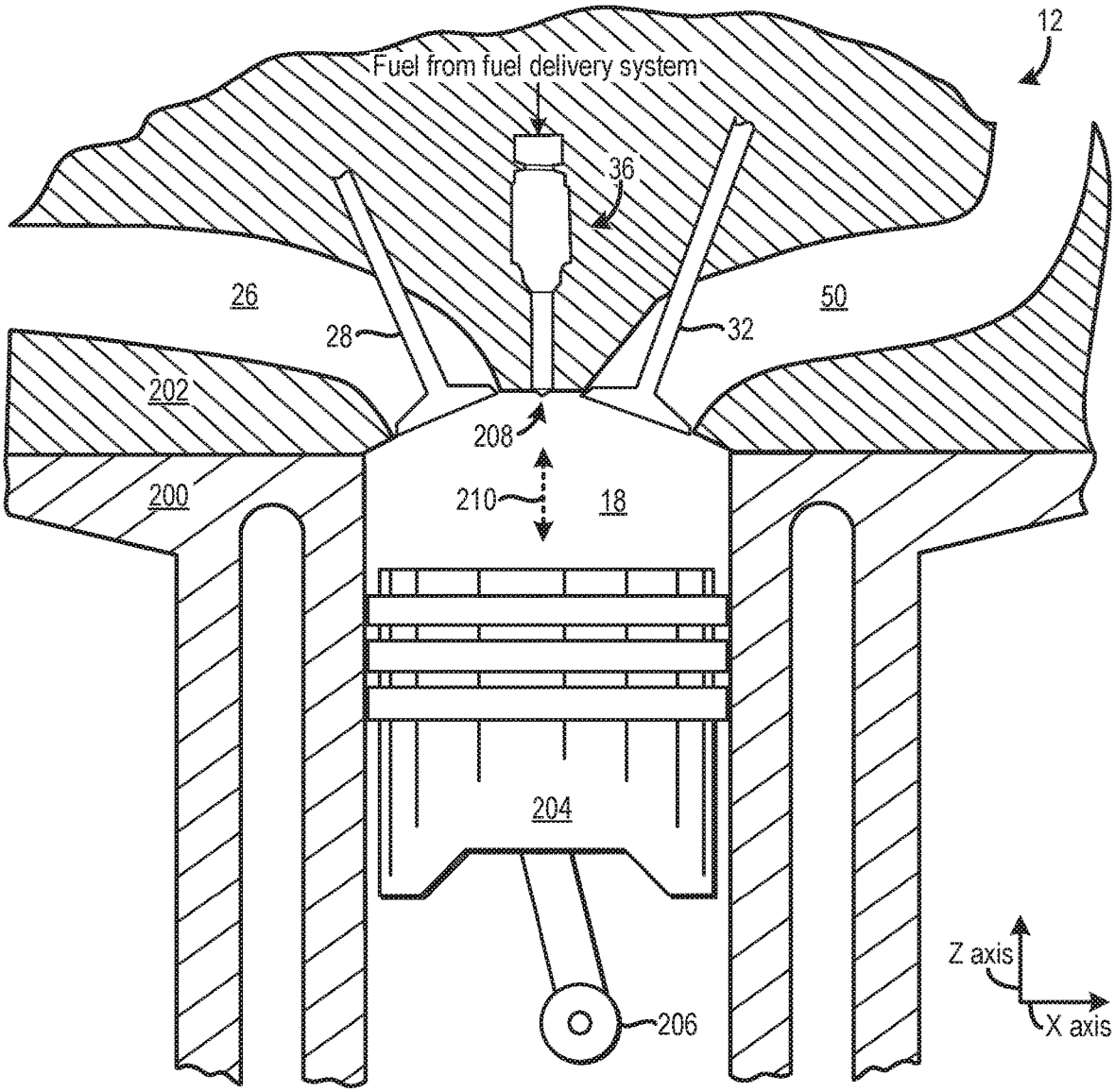
FIG. 2 shows an illustration of an example cylinder with a direct fuel injector in the internal combustion engine, shown in FIG. 1, in cross-section.
Figure 3:
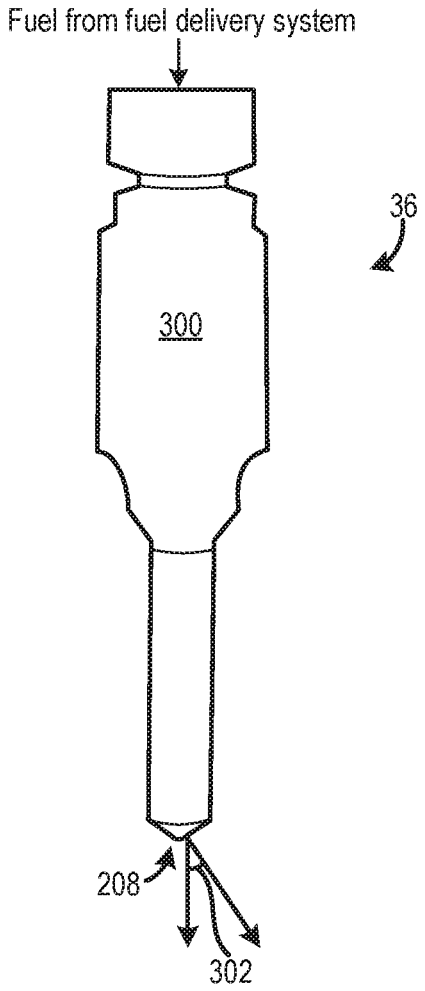
FIG. 3 shows a detailed illustration of the direct fuel injector, shown in FIG. 2.
Figure 4:
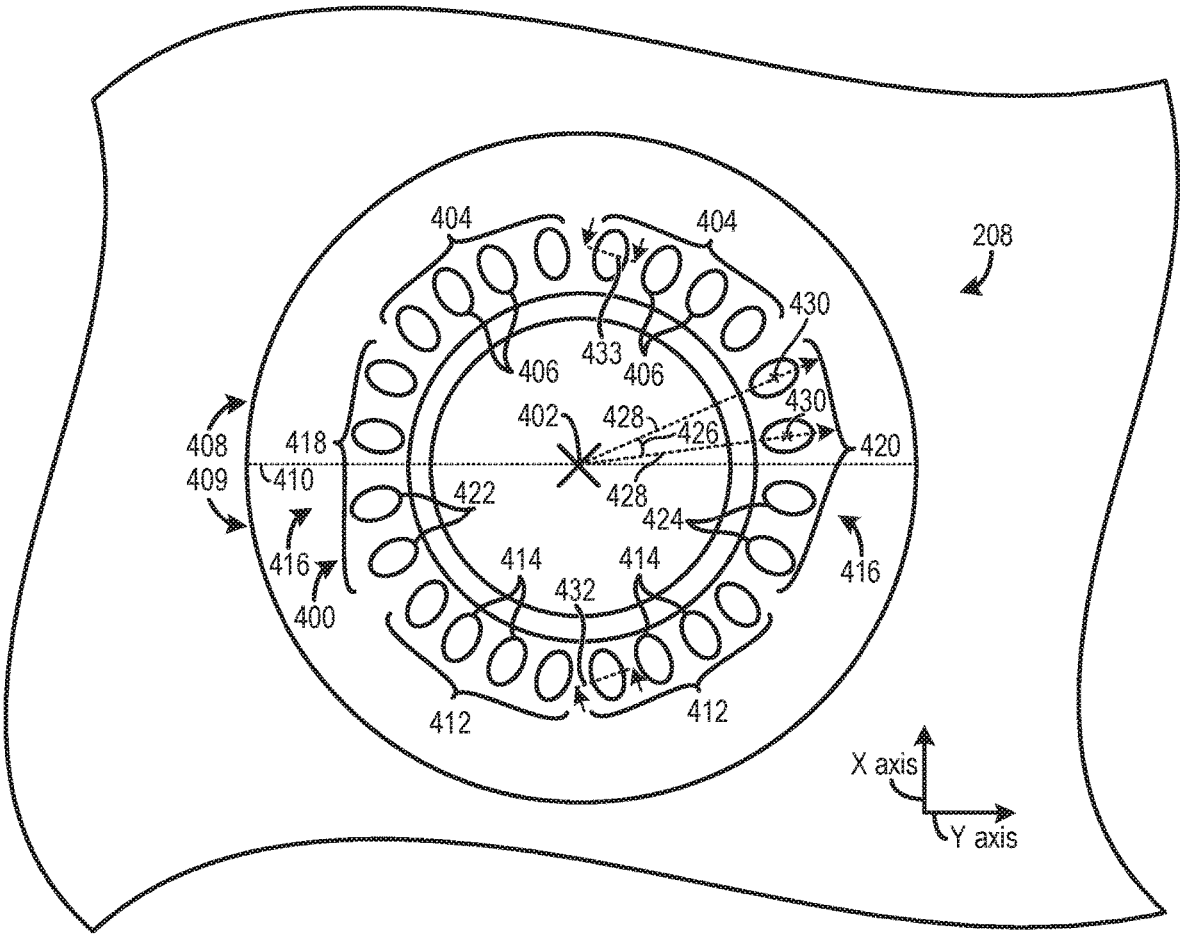
FIG. 4 shows a first embodiment of a nozzle included in the direct fuel injector, shown in FIG. 3.
Figure 5:
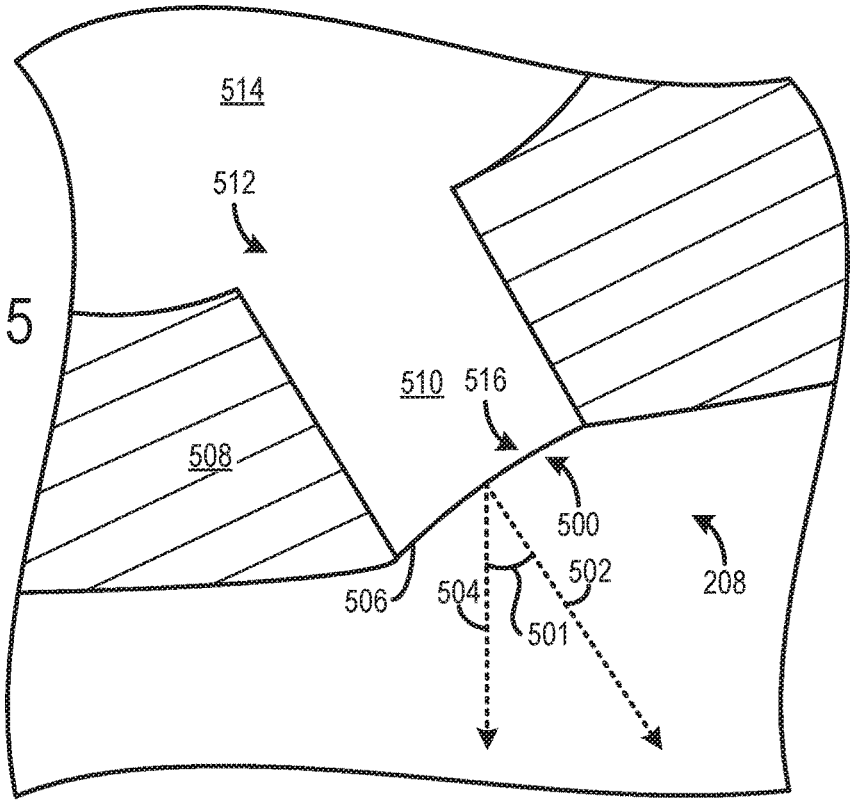
FIG. 5 shows a detailed view of an orifice in the nozzle, shown in FIG. 4, in cross-section.
Figure 6:
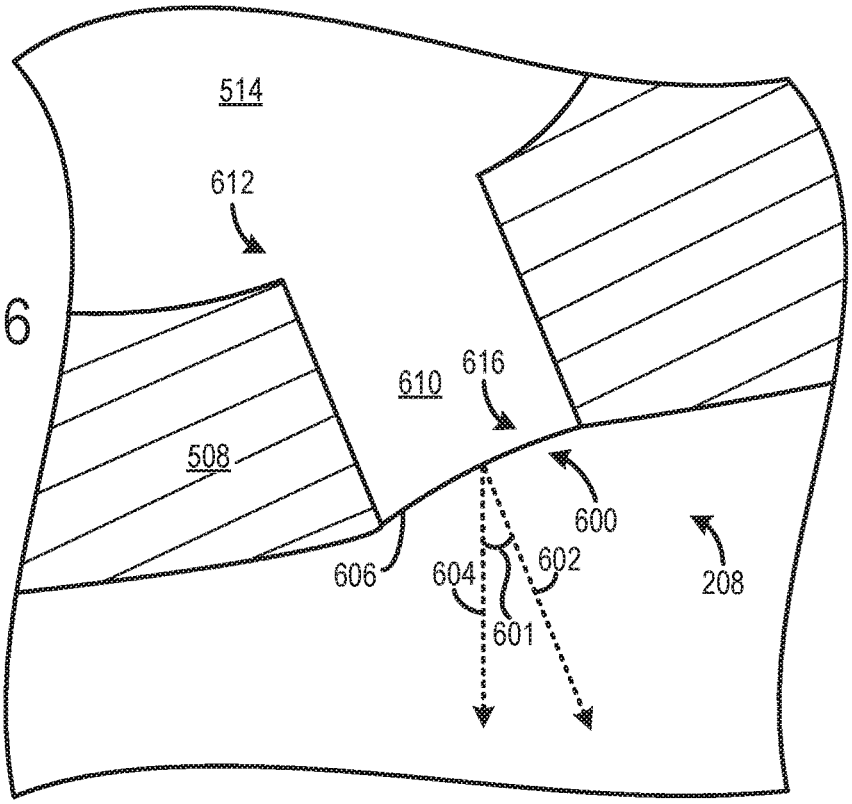
FIG. 6 shows a detailed view of another orifice in the nozzle, shown in FIG. 4, in cross-section.
Figure 7:
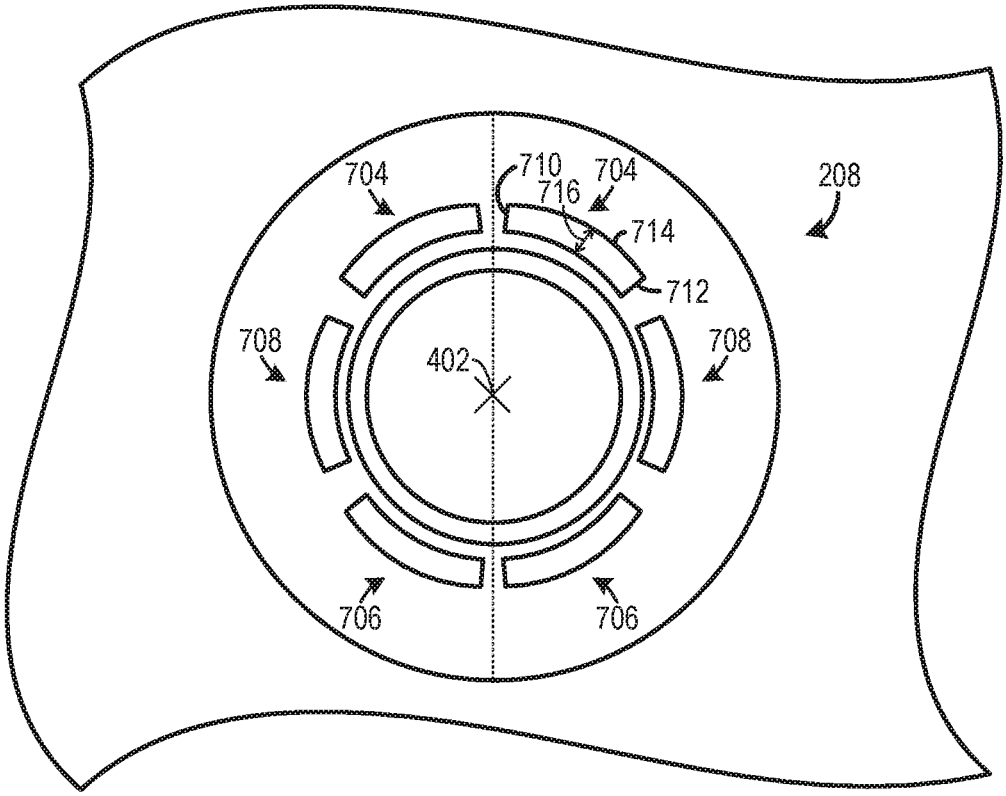
FIG. 7 shows a second embodiment of the nozzle included in the direct fuel injector, shown in FIG. 3.
Figure 8:
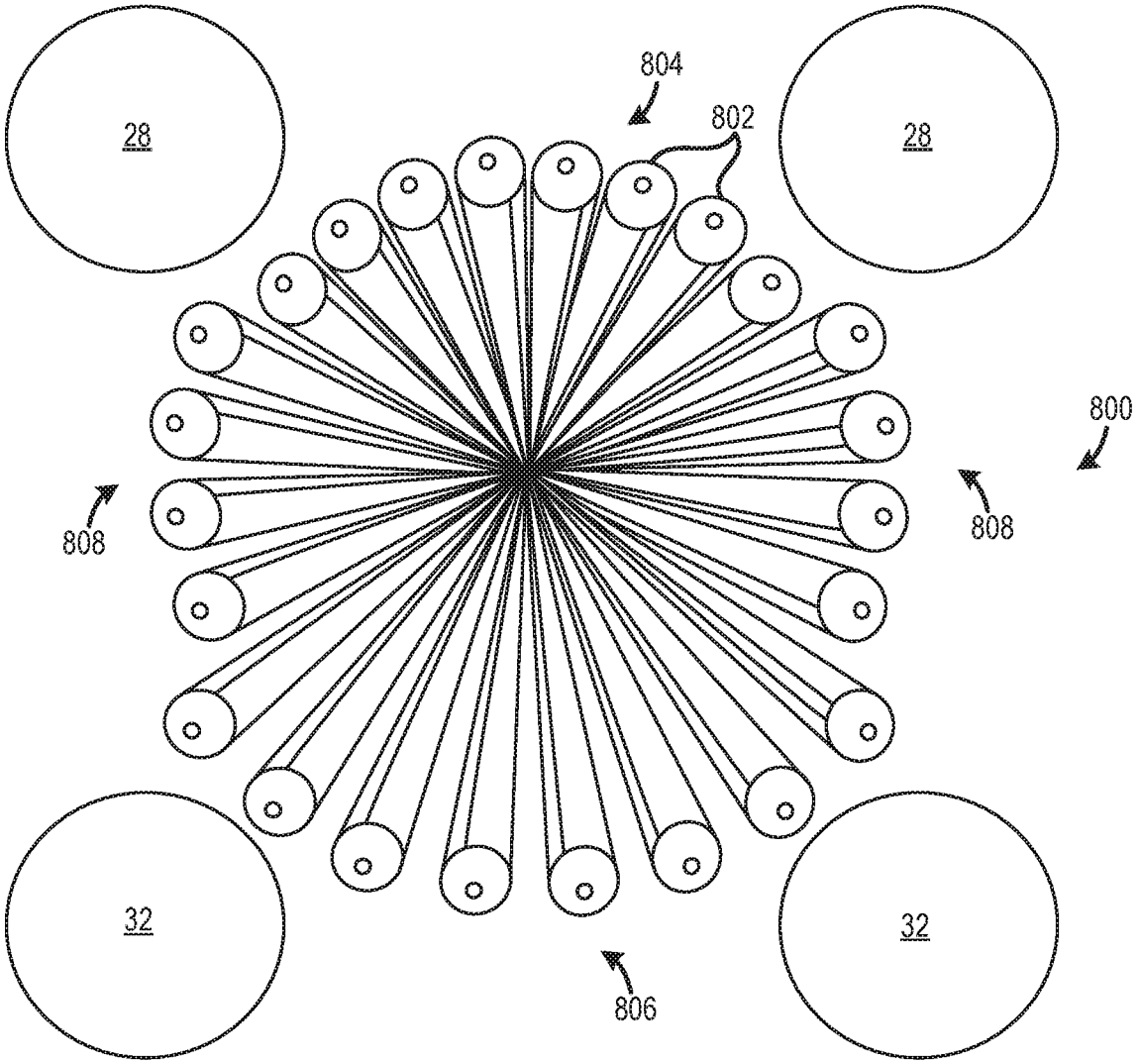
FIG. 8 shows a view of the spray pattern generated by the direct fuel injector, shown in FIG. 3.

FIG. 1 shows a schematic depiction of a vehicle with an internal combustion engine including a fuel delivery system having a direct fuel injector. FIG. 2 shows an example of the cylinder and direct fuel injector in the fuel delivery system, shown in FIG. 1, in cross-section. FIG. 3 shows a detailed view of the direct fuel injector, shown in FIG. 2. FIG. 4 shows a first embodiment of a nozzle of the direct fuel injector, shown in FIG. 3, configured to generate fuel spray in an arcing pattern resembling petals. FIGS. 5 and 6 show a detailed view of different orifices included in the nozzle, shown in FIG. 4, in cross-section, to highlight the different angular arrangement of the orifices. FIG. 7 shows a second embodiment of a nozzle of the direct fuel injector, shown in FIG. 2. FIG. 8 shows a spray pattern generated by the nozzle of the direct fuel injector, shown in FIG. 4.

Turning to FIG. 1, a vehicle 10 having an engine 12 with a fuel delivery system 14 is schematically illustrated. Although, FIG. 1 provides a schematic depiction of various engine and fuel delivery system components, it will be appreciated that at least some of the components may have a different spatial positions and greater structural complexity than the components shown in FIG. 1. The structural details of the components are discussed in greater detail herein with regard to FIGS. 2-8.

An intake system 16 providing intake air to a cylinder 18 is also depicted in FIG. 1. Although, FIG. 1 depicts the engine 12 with one cylinder, the engine 12 may have an alternate number of cylinders. For instance, the engine 12 may include two cylinders, three cylinders, six cylinders, etc., in other examples.

The intake system 16 includes an intake conduit 20 and a throttle 22 coupled to the intake conduit. The throttle 22 is configured to regulate the amount of airflow provided to the cylinder 18. In the depicted example, the intake conduit 20 feeds air to an intake manifold 24. The intake manifold 24 is coupled to and in fluidic communication with intake runners 26. The intake runners 26 in turn provide intake air to intake valves 28. In the illustrated example, two intake valves are depicted in FIG. 1. However, in other examples, the cylinder 18 may include a single intake valve or more than two intake valves. The intake manifold 24, intake runners 26, and intake valves 28 are included in the intake system 16.

The intake valves 28 may be actuated by intake valve actuators 30. Likewise, exhaust valves 32 coupled to the cylinder 18 may be actuated by exhaust valve actuators 34. In particular, each intake valve may be actuated by an associated intake valve actuator and each exhaust valve may be actuated by an associated exhaust valve actuator. In one example, the intake valve actuators 30 as well as the exhaust valve actuators 34 may employ cams coupled to intake and exhaust camshafts, respectively, to open/close the valves. Continuing with the cam driven valve actuator example, the intake and exhaust camshafts may be rotationally coupled to a crankshaft. Further in such an example, the valve actuators may utilize one or more of cam profile switching (CPS), variable cam timing (VCT), variable valve timing (VVT) and/or variable valve lift (VVL) systems to vary valve operation. Thus, cam timing devices may be used to vary the valve timing, if desired. It will therefore be appreciated, that valve overlap may occur in the engine, if desired. In another example, the intake and/or exhaust valve actuators, 30 and 34, may be controlled by electric valve actuation. For example, the valve actuators, 30 and 34, may be electronic valve actuators controlled via electronic actuation. In yet another example, cylinder 18 may alternatively include an exhaust valve controlled via electric valve actuation and an intake valve controlled via cam actuation including CPS and/or VCT systems. In still other embodiments, the intake and exhaust valves may be controlled by a common valve actuator or actuation system.

The fuel delivery system 14 provides pressurized fuel to a direct fuel injector 36. The fuel delivery system 14 includes a fuel tank 38 storing liquid fuel (e.g., gasoline, diesel, bio-diesel, alcohol (e.g., ethanol and/or methanol) and/or combinations thereof). The fuel delivery system 14 further includes a fuel pump 40 pressurizing fuel and generating fuel flow to a direct fuel injector 36. A fuel conduit 42 provides fluidic communication between the fuel pump 40 and the direct fuel injector 36. The direct fuel injector 36 is coupled (e.g., directly coupled) to the cylinder 18. The direct fuel injector 36 is configured to provide metered amounts fuel to the cylinder 18. The fuel delivery system 14 may include additional components, not shown in FIG. 1. For instance, the fuel delivery system 14 may include a second fuel pump. In such an example, the first fuel pump may be a lift pump and the second fuel pump may be a high-pressure pump, for instance. Additional fuel delivery system components may include check valves, return lines, etc., to enable fuel to be provided to the injector at desired pressures.

An ignition system 44 (e.g., distributorless ignition system) is also included in the engine 12. The ignition system 44 provides an ignition spark to cylinder via ignition device 46 (e.g., spark plug) in response to control signals from the controller 100. However, in other examples, the engine may be designed to implement compression ignition, and therefore the ignition system may be omitted, in such an example.

An exhaust system 48 configured to manage exhaust gas from the cylinder 18 is also included in the vehicle 10, depicted in FIG. 1. The exhaust system 48 includes the exhaust valves 32 coupled to the cylinder 18. In particular, two exhaust valves are shown in FIG. 1. However, engines with an alternate number of exhaust valves have been contemplated, such as an engine with a single exhaust valve, three exhaust valves, etc. The exhaust valves 32 are in fluidic communication with exhaust runners 50. The exhaust runners 50 are coupled to and in fluidic communication with an exhaust manifold 52. The exhaust manifold 52 is in turn coupled to an exhaust conduit 54. The exhaust runners 50, exhaust manifold 52, and exhaust conduit 54 are included in the exhaust system 48. The exhaust system 48 also includes an emission control device 56 coupled to the exhaust conduit 54. The emission control device 56 may include filters, catalysts, absorbers, etc., for reducing tailpipe emissions.

During engine operation, the cylinder 18 typically undergoes a four stroke cycle including an intake stroke, compression stroke, expansion stroke, and exhaust stroke. During the intake stroke, generally, the exhaust valves close and intake valves open. Air is introduced into the cylinder via the corresponding intake passage, and the cylinder piston moves to the bottom of the cylinder so as to increase the volume within the cylinder. The position at which the piston is near the bottom of the cylinder and at the end of its stroke (e.g., when the combustion chamber is at its largest volume) is typically referred to by those of skill in the art as bottom dead center (BDC). During the compression stroke, the intake valves and exhaust valves are closed. The piston moves toward the cylinder head so as to compress the air within combustion chamber. The point at which the piston is at the end of its stroke and closest to the cylinder head (e.g., when the combustion chamber is at its smallest volume) is typically referred to by those of skill in the art as top dead center (TDC). In a process herein referred to as injection, fuel is introduced into the cylinder. In a process herein referred to as ignition, the injected fuel in the combustion chamber is ignited via a spark from an ignition device (e.g., spark plug) and/or compression, in the case of a compression ignition engine. During the expansion stroke, the expanding gases push the piston back to BDC. A crankshaft converts this piston movement into a rotational torque of the rotary shaft. During the exhaust stroke, in a traditional design, exhaust valves are opened to release the residual combusted air-fuel mixture to the corresponding exhaust passages and the piston returns to TDC.

FIG. 1 also shows a controller 100 in the vehicle 10. Specifically, controller 100 is shown in FIG. 1 as a conventional microcomputer including: microprocessor unit 102, input/output ports 104, read-only memory 106, random access memory 108, keep alive memory 110, and a conventional data bus. Controller 100 is configured to receive various signals from sensors coupled to the engine 12. The sensors may include engine coolant temperature sensor 120, exhaust gas sensors 122, an intake airflow sensor 124, etc. Additionally, the controller 100 is also configured to receive throttle position (TP) from a throttle position sensor 112 coupled to a pedal 114 actuated by an operator 116.

Furthermore, the controller 100 may be configured to trigger one or more actuators and/or send commands to components. For instance, the controller 100 may trigger adjustment of the throttle 22, intake valve actuators 30, exhaust valve actuators 34, ignition system 44, and/or fuel delivery system 14. Specifically, the controller 100 may be configured to send signals to the ignition device 46 and/or direct fuel injector 36 to adjust operation of the spark and/or fuel delivered to the cylinder 18. Therefore, the controller 100 receives signals from the various sensors and employs the various actuators to adjust engine operation based on the received signals and instructions stored in memory of the controller. Thus, it will be appreciated that the controller 100 may send and receive signals from the fuel delivery system 14.

For example, adjusting the direct fuel injector 36 may include adjusting a fuel injector actuator to adjust the direct fuel injector. In yet another example, the amount of fuel to be delivered via the direct fuel injector 36 may be empirically determined and stored in predetermined lookup tables or functions. For example, one table may correspond to determining direct injection amounts. The tables may be indexed to engine operating conditions, such as engine speed and engine load, among other engine operating conditions. Furthermore, the tables may output an amount of fuel to inject via direct fuel injector to the cylinder at each cylinder cycle. Moreover, commanding the direct fuel injector to inject fuel may include at the controller generating a pulse width signal and sending the pulse width signal to the direct fuel injector.

FIG. 2 shows a cross-section of an example of the engine 12. The engine 12 is shown including a cylinder block 200 coupled to a cylinder head 202 forming the cylinder 18. One of the exhaust valves 32 and one of the intake valves 28, are shown in FIG. 2. Therefore, it will be appreciated that the additional exhaust and intake valves are hidden from view in FIG. 2. However, in other examples, only one intake and one exhaust valve may be coupled to the cylinder.

Additionally, a piston 204 is disposed within the cylinder 18 and connected to a crankshaft 206. The direct fuel injector 36 and specifically a nozzle 208 of the direct fuel injector 36 is shown positioned in an upper region of the cylinder 18 with regard to a central axis 210 of the cylinder 18. Additionally, the direct fuel injector 36 is also positioned horizontally between the intake valve 28 and the exhaust valve 32, in the illustrated example. Specifically, the nozzle 208 of the direct fuel injector 36 is position between the intake valve 28 and the exhaust valve 32 with regard to a horizontal axis. Coordinate axes X and Z are provided for reference. In one example, the Z axis may be parallel to a gravitational axis. Further, the X axis may be a lateral or horizontal axis.

FIG. 2 also shows one of the intake runners 26 in fluidic communication with the intake valve 28. Likewise, FIG. 2 additionally shows one of the exhaust runners 50 in fluidic communication with the exhaust valve 32. It will be appreciated that the exhaust runner, shown in FIG. 2, flows exhaust gas to downstream components in the exhaust system. On the other hand, the intake runner shown in FIG. 2 receives intake air from upstream intake system components.

The direct fuel injector 36 is also shown receiving fuel from a fuel source in the fuel delivery system 14, shown in FIG. 1. It will be appreciated that the fuel source may be one or more of the upstream components in the fuel delivery system, such as a fuel conduit, fuel pump, fuel tank, fuel rail, etc.

FIG. 3 shows a detailed view of the direct fuel injector 36, shown in FIG. 2. The direct fuel injector 36 includes a body 300. The body 300 is configured to receive fuel from a fuel source in the fuel delivery system 14, shown in FIG. 1. The body 300 may include an actuator (e.g., solenoid) that receives control signals from the controller 100, shown in FIG. 1.

Continuing with FIG. 3, the direct fuel injector 36 further includes the nozzle 208 configured to spray metered amounts of fuel into the cylinder 18, shown in FIG. 2. An example orifice angle 302, is shown in FIG. 3. The orifice angle 302 may corresponding to a single orifice included in the nozzle 208. Specifically in one example, the orifice angle 302 may be a theta angle (θ) of the associated orifice. Orifice angles of the nozzle are discussed in greater detail herein with regard to FIGS. 4, 5, and 6.

FIG. 4 shows a detailed view of a first embodiment of the nozzle 208 in the direct fuel injector 36, shown in FIG. 3. In FIG. 4, the nozzle of the fuel injector is viewed from an upward perspective. The Y axis and the X axis are provided for reference. The Y axis may be a longitudinal axis and the X axis may be a lateral axis, or vice versa. The nozzle 208 includes a plurality of orifices 400 configured to receive fuel from the injector body 300, shown in FIG. 3. The orifices are shown arranged in an arc around a central axis 402 of the nozzle 208. Specifically in the depicted example, the orifices circumferentially surround the central axis 402 at equivalent radii. However, in other instances, the orifices may only extend part of the way around the central axis 402 or may include groups of orifices spaced away from each other on different sides of the nozzle 208. In yet another example, the plurality of orifices many have varying radii with regard to the central axis. Furthermore, each of the orifices may arranged at a common vertical position (e.g., depth) with regard to the central axis 402 of the nozzle 208, in one example. The central axis 402 of the nozzle 208 may be parallel to the central axis 210 of the cylinder 18 and/or the Z axis, shown in FIG. 2.

The orifices in the nozzle 208 can be conceptually divided into different sets. Thus, the nozzle 208 includes a first set of orifices 404 having a plurality of orifices 406. The first set of orifices 404 is arranged on an intake side 408 of the nozzle 208. An exemplary line 410 that may be the dividing line between an exhaust side 409 and intake side 408 of the nozzle 208, extending through the central axis 402, is illustrated in FIG. 4. However, the sides of the nozzle 208 may be defined using other boundaries. It will be appreciated, that the intake side of the nozzle may be near to one or more intake valves coupled to the cylinder in which the nozzle is positioned. It will also be appreciated, that the exhaust side of the nozzle may be near one or more exhaust valves coupled to the cylinder.

Each of the orifices 406 included in the first set of orifices 404 may be arranged at a similar orifice angle (e.g., theta angle (θ)). An exemplary orifice angle of one of the orifices included in the nozzle 208, is shown in detail in FIG. 5, and discussed in greater detail herein. However, in other examples, the orifice angle of the orifices may not be equivalent in the first set of orifices. For instance, the orifice angles of the orifices in the first set may increase or decrease in clockwise or counterclockwise direction about the central axis 402. In one example, the orifice angle of the orifices 406 in the first set of orifices 404 may be less than 30° or may be between 25° and 30°. Specifically in one particular example, the orifice angle of each of the orifices 406 in the first set of orifices 404 may be 27.4°. When the orifices in the first set are arranged at angles within aforementioned angle ranges or specifically at 27.4°, fuel spray from the orifices may be directed away from the cylinder walls and piston while enabling deep cylinder penetration. As a result, cylinder wall wetting is reduced during combustion operation in the engine. Consequently, engine emissions (e.g., particulate matter emissions and smoke emissions) may be reduced and combustion efficiency may be increased.

Additionally, the nozzle 208 includes a second set of orifices 412 having a plurality of orifices 414. The second set of orifices 412 is arranged on the exhaust side 409 of the nozzle 208. Each of the orifices 414 included in the second set of orifices 412 may be arranged at a similar orifice angle (e.g., theta angle (θ)). Moreover, the orifice angle of the orifices 414 in the second set of orifices 412 may be greater than the orifice angle of the orifices 404 in the first set of orifices 404. In this way, the orifice angles of the sets of orifices are varied to enable fuel to be sprayed in arcs with different angles of penetration to generate a spray pattern conducive to reducing wall wetting. In one particular example, the orifice angle of the orifices 414 in the second set of orifices 412 may be greater than 30° or may specifically be between 35° and 45°. Specifically, in one particular example, the orifice angle of the orifices 414 in the second set of orifices 412 may be 40.1°. However, in other examples, the orifice angle of the orifices in the second set may not be equivalent. For instance, the orifices angles of the orifices in the second set may increase or decrease in a clockwise or counterclockwise direction about the central axis 402.

Furthermore, the nozzle 208 includes a third set of orifices 416. The third set of orifices 416 can be conceptually divided into a first orifice group 418 and a second orifice group 420. The first orifice group 418 includes a plurality of orifices 422 and the second orifice group 420 likewise includes a plurality of orifices 424.

In the illustrated example, the first orifice group 418 and the second orifice group 420 are spaced away from each other. In particular, the first and second orifice groups, 418 and 420, are positioned on opposing sides of the nozzle 208. Furthermore, the third set of orifices 416 is positioned between the first set of orifices 404 and the second set of orifices 412. The plurality of orifices 422 included in the first orifice group 418 extend from the intake side 408 of the nozzle 208 to the exhaust side 409 of the nozzle, across the dividing line 410. Similarly, the plurality of orifices 424 included in the second orifice group 420 also extend from the intake side 408 to the exhaust side 409 of the nozzle 208. Arranging the third set of orifices in this manner enables additional targeting of fuel away from the cylinder walls. Consequently, wall wetting is further decreased during engine combustion.

In one example, the first set of orifices 404, the second set of orifices 412, and/or the third set of orifices 416 may be designed based on engine events to target specific cylinder regions. For instance, the orifice angles of one or more of the sets of orifices may be design to improve air/fuel mixing during partial load, at the same time without jeopardizing emissions performance by keeping the fuel-wall impingement low. In another example, the orifice angles of one or more of the sets of orifices may be design to increase combustion efficiency during a cold start when the air/fuel charge is stratified. Continuing with such an example, the targets of first set of orifices 412, may be designed to deliver fuel to the spark plug region to provide stable combustion.

Each of the orifices included in the third set of orifices 416 may be arranged at a similar orifice angle (e.g., theta angle (θ)). Moreover, the orifice angle of the orifices in the third set of orifices 416 may be greater than the orifice angle of the orifices in the first set of orifices 404 and less than the angle of the orifices in the second set of orifices 412. In this way, the orifice angle (e.g., theta angle) of the orifices increases in a direction toward the intake valves. In one particular example, the orifice angle of the orifices in the third set of orifices 416 may be between 30° and 35°. Specifically, in one particular example, the orifice angle of the orifices in the third set of orifices 416 may be 32.4°. In other examples, however, the orifice angle of the orifices in the third set may not be equivalent. For instance, the orifice angles of the orifices in the third set may increase or decrease in a clockwise or counterclockwise direction.

Further, in FIG. 4, each of the sets of orifices includes eight (8) orifices. Thus, the total number of orifices in the nozzle 208 is twenty-four (24). However, a nozzle with an alternate number of orifices has been contemplated. For instance, the nozzle may include twenty-eight (28) or sixteen (16) orifices in other examples.

Additionally, in FIG. 4, each of the orifices in the first, second, and third sets of orifices, 404, 412, and 416, respectively, may have a similar diameter and shape. In one example, the orifice may have a circular or oval shape. In the case of an oval shape, each orifice may have a large and small diameter. However, other orifice shapes have been contemplated. In one instance, the diameter of the orifices may be less than 85 microns (μm). When the orifice diameter is less than the aforementioned threshold diameter, the fuel plume generated by the nozzle may have smaller droplets that promote further wall wetting reductions. In other examples, however, the diameter and shape of the orifices may vary. For instance, the diameter of the first set of orifices may be greater than the diameter of the second set of orifices or vice versa. In yet another example, the third set of orifices may have a greater diameter than the first set of orifices and a smaller diameter than the second set of orifices. In other examples, the diameter of the orifices may vary in each set of orifices. For example, the diameter of the orifices in the first set may increase or decrease in a clockwise or counterclockwise direction.

Further in the illustrated example, each of the orifices in the first, second, and third set of orifices, 404, 412, and 416 respectively, are sequentially spaced apart at equivalent azimuthal angles measured about the central axis 402 of the nozzle 208. An azimuthal angle 426 formed by the intersection of lines 428 extending through centers 430 of two orifices and the central axis 402, is illustrated in FIG. 4. Specifically, in the depicted example, the azimuthal angle is 15°. However, other azimuthal angle values have been contemplated, such at 10°, 20°, 30°, etc. Viewing plane 432 indicating the cross-section of FIG. 5, is also provided in FIG. 4. Viewing plane 433 indicates the cross-section of FIG. 6, is also illustrated in FIG. 4.

FIG. 5 shows a detailed view of one of the orifices 500 included in the nozzle 208 depicted in FIG. 4. Specifically, the orifice 500 is one of the orifices included in the second set of orifices 412. FIG. 5 shows the orifice 500 arranged at an orifice angle 501. The orifice angle 501 may be an angle formed between a centerline 502 of the orifice 500 and a vertical axis 504. In one example, the vertical axis 504 may be parallel to the central axis 210 of the cylinder 18, shown in FIG. 2. Furthermore, the centerline 502 may be perpendicular to a plane extending through an outer face 506 of the orifice 500.

FIG. 5 also shows a passage 510 extending through a nozzle tip 508. The passage 510 includes an inlet 512 receiving fuel from a tip cavity 514 and an outlet 516 at the orifice 500 that opens into the cylinder 18, shown in FIG. 2. The tip cavity 514 may receive metered amounts of fuel from upstream injector components, such as the injector body 300, shown in FIG. 2.

FIG. 6 shows a detailed view of one of the orifices 600 included in the nozzle 208, depicted in FIG. 4. Specifically, the orifice 600 is one of the orifices included in the first set of orifices 404. The orifice 600 is arranged at an orifice angle 601. The orifice angle 601 may be an angle formed between a centerline 602 of the orifice 600 and a vertical axis 604. In one example, the vertical axis 604 may be parallel to the central axis 210 of the cylinder 18, shown in FIG. 2. Furthermore, the centerline 602 may be perpendicular to a plane extending through an outer face 606 of the orifice 600.

When contrastingly FIGS. 5 and 6, it is clear that the angle 601 of the orifice 600, shown in FIG. 6, is less than the angle 501 of the orifice 500, shown in FIG. 5. Specifically in one example, the angle 601 may be 27.4° and the angle 501 may be 40.1°. Varying the angles of the nozzles in this way enables the nozzle to generate a spray pattern that is conducive to reducing wall wetting.

Additionally, FIG. 6 shows a passage 610 extending through the nozzle tip 508. The passage 610 includes an inlet 612 receiving fuel from the tip cavity 514 and an outlet 616 at the orifice 600 that opens into the cylinder 18, shown in FIG. 2. The tip cavity 514 may receive metered amounts of fuel from upstream injector components, such as the injector body 300, shown in FIG. 2.

FIG. 7 shows a second embodiment of the nozzle 208. In the second embodiment, orifices in the nozzle have a slit shape that arc around the central axis 402. Specifically, a first set of slits 704, a second set of slits 706, and a third set of slits 708. The slits in each of the sets of slits may each have a similar size and profile. However, in other examples, the size and profile of the slits in each set may vary. As shown, each slit includes a first end 710 and a second end 712 with an arc section 714 extending between the first and second ends. In the depicted example, a width 716 of the arc section remains constant along its length. However, in other examples, the width of the arc section may vary along its length. The benefit of the slit design is to have smaller opening, which can be less than the threshold of 85 microns (μm), in nozzle-shape design. The slit design can deliver the same amount of fuel with smaller opening thru maintaining the same total opening area. The smaller opening/width will potentially further reduce the spray penetration by generating smaller fuel droplets.

The slits may have similar angles (e.g., theta angles, azimuthal angles) to the angles of the sets of orifices previously described with regard to the first embodiment of the nozzle, shown in FIG. 4. For instance, the first set of slits 704 may be arranged at theta angle (θ) that is less than the theta angle (θ) of the second set of slits 706. Moreover, the positioning of the first, second, and third sets of slits, 704, 706, and 708, respectively, in FIG. 7, may have a similar relative position and/or shape with regard to the first, second, and third sets of orifices, 404, 412, and 416, respectively, of the embodiment of the nozzle 208, shown in FIG. 4. Therefore, redundant descriptions are omitted.

FIG. 8 shows a spray pattern 800 of the nozzle 208, shown in FIG. 4. The intake valves 28 and the exhaust valves 32 are also shown in FIG. 8, for reference. As shown, fuel plumes 802 corresponding to the orifices of the nozzle 208, depicted in FIG. 4, are illustrated. As depicted, the fuel plumes 802 form arcs 804, 806, and 808 resembling the shape of a petal. In FIG. 8, each arc corresponds to a different set of orifices in the nozzle. In particular, arc 804 corresponds to the first set of orifices 404, arc 806 corresponds to the second set of orifices 412, and arcs 808 corresponds to the third set of orifices 416, shown in FIG. 4. Continuing with FIG. 8, when the fuel plumes 802 form the petal like shape wall wetting within the cylinder may be reduced. Specifically, the angular arrangement of the orifices may cause a reduction in fuel impingement on the cylinder wall and the piston. As a result, emissions and in particular smoke and particulate matter emission may be reduced while increasing combustion efficiency. Therefore, the technical effect of arranging the orifices at angles to generate separate fuel plumes directed towards the intake and exhaust valves may be a decrease in emissions and an increase in combustion efficiency.

FIGS. 1-8 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

The invention will further be described in the following paragraphs. In one aspect, a direct fuel injector is provided. The direct fuel injector comprises a nozzle in fluidic communication with a fuel source, including, a first set of orifices, each of the orifices in the first set arranged at a first orifice angle on an intake side of the nozzle, and a second set of orifices, each of the orifices in the second set arranged at a second orifice angle less than the first orifice angle on an exhaust side of the nozzle.

In another aspect, a fuel delivery system is provided. The fuel delivery system comprises a cylinder, an exhaust valve coupled to the cylinder, an intake valve coupled to the cylinder, and a direct fuel injector coupled to the cylinder, the direct fuel injector including, a body receiving fuel from a fuel source, and a nozzle in fluidic communication with the body, the nozzle including a first set of orifices including a plurality of orifices, each of the plurality of orifices in the first set of orifices arranged at a first orifice angle on an intake side of the nozzle, and a second set of orifices including a plurality of orifices, each of the plurality of orifices in the second set of orifices arranged at a second orifice angle on an exhaust side of the nozzle, the first orifice angle less than the second orifice angle, where each of the first orifice angle and the second orifice angle is an angle formed between a centerline of a corresponding orifice and a vertical axis.

In another aspect, a direct fuel injector is provided. The direct fuel injector comprises a body receiving fuel from a fuel source, and a nozzle in fluidic communication with the body, the nozzle including, a first set of orifices including a plurality of orifices, each of the plurality of orifices in the first set of orifices arranged at a first orifice angle and positioned on an intake side of the nozzle, a second set of orifices including a plurality of orifices, each of the plurality of orifices in the second set of orifices arranged at a second orifice angle and positioned on an exhaust side of the nozzle, where the second orifice angle is less than the first orifice angle, and a third set of orifices including a plurality of orifices, each of the plurality of orifices in the third set of orifices arranged at a third orifice angle, where the third orifice angle is less than the second orifice angle and greater than the first orifice angle, where each of the first, second, and third orifice angles is an angle formed between a centerline of a corresponding orifice and a vertical axis.

In any of the aspects herein or combinations of the aspects, each of the first orifice angle and the second orifice angle may be an angle formed between a centerline of a corresponding orifice and a vertical axis.

In any of the aspects herein or combinations of the aspects, the first orifice angle may be less than 30 degrees and the second orifice angle may be greater than 30 degrees.

In any of the aspects herein or combinations of the aspects, the first orifice angle may be between 35 and 45 degrees and the second orifice angle may be between 25 and 35 degrees.

In any of the aspects herein or combinations of the aspects, the direct fuel injector may further include a third set of orifices positioned between the first set of orifices and the second set of orifices, the third set of orifices arranged at a third orifice angle, where the third orifice angle may be less than the second orifice angle and greater than the first orifice angle.

In any of the aspects herein or combinations of the aspects, the third set of orifices may include a first orifice group spaced away from a second orifice group and where the first and second orifice groups may each arranged in an arc extending from the intake side of the nozzle to the exhaust side of the nozzle.

In any of the aspects herein or combinations of the aspects, the first set of orifices and the second set of orifices may each be arranged in an arc about a central axis of the nozzle and have a common vertical position with regard to a vertical axis.

In any of the aspects herein or combinations of the aspects, each of the orifices in the first set of orifices and the second set of orifices may be sequentially spaced apart at equivalent azimuthal angles measured about the central axis of the nozzle.

In any of the aspects herein or combinations of the aspects, a diameter of each of the orifices in the first and second set of orifices may be less than 85 microns.

In any of the aspects herein or combinations of the aspects, the orifices included in each of the first set of orifices and the second set of orifices may have a slit shape with an arc section extending between a first end and a second end.

In any of the aspects herein or combinations of the aspects, the nozzle may be positioned between an intake valve and an exhaust valve with regard to a horizontal axis.

In any of the aspects herein or combinations of the aspects, the fuel delivery system may further include a third set of orifices positioned between the first set of orifices and the second set of orifices, the third set of orifices arranged at a third orifice angle, where the third orifice angle may be less than the second orifice angle and greater than the first orifice angle.

In any of the aspects herein or combinations of the aspects, the first orifice angle may be between 25 and 30 degrees and the second orifice angle may be between 35 and 45 degrees.

In any of the aspects herein or combinations of the aspects, the direct fuel injector may be positioned between the intake valve and the exhaust valve with regard to a horizontal axis.

In any of the aspects herein or combinations of the aspects, the third sets of orifices may extend from the intake side of the nozzle to the exhaust side of the nozzle.

In any of the aspects herein or combinations of the aspects, the first orifice angle may be between 25 and 30 degrees, the second orifice angle may be between 35 and 45 degrees, and the third orifice angle may be between 30 and 35 degrees.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A fuel delivery system, comprising:

a cylinder;

an exhaust valve coupled to the cylinder;

an intake valve coupled to the cylinder; and a direct fuel injector coupled to the cylinder, comprising:

a nozzle in fluidic communication with a fuel source, including:

a first set of orifices, each of the orifices in the first set arranged at a first orifice angle, and the first set of orifices extending in an arc on an intake side of the nozzle; and a second set of orifices, each of the orifices in the second set arranged at a second orifice angle greater than the first orifice angle, and the second set of orifices extending in an arc on an exhaust side of the nozzle, where only one ring of orifices surrounds a central axis of the nozzle in a plane of an x-axis and a y-axis of the nozzle, each orifice of the ring of orifices positioned at equivalent radii from the central axis in the plane, where the first set of orifices and the second set of orifices are part of the ring of orifices, wherein each of the first orifice angle and the second orifice angle is an angle formed between a centerline of a corresponding orifice and a vertical axis of the nozzle, where the centerline of the corresponding orifice is perpendicular to an outer face plane of the corresponding orifice, where the first set of orifices is the only set located entirely on the intake side of the nozzle, and where the second set of orifices is the only set located entirely on the exhaust side of the nozzle.

2. The fuel delivery system of claim 1, where the vertical axis extends parallel to a z-axis, where the z-axis is perpendicular to the x-axis, and where the x-axis is perpendicular to the y-axis.

3. The fuel delivery system of claim 1, where the first orifice angle is less than 30 degrees and the second orifice angle is greater than 30 degrees.

4. The fuel delivery system of claim 1, where the first orifice angle is between 25 and 30 degrees and the second orifice angle is between 35 and 45 degrees.

5. The fuel delivery system of claim 1, further comprising a third set of orifices positioned between the first set of orifices and the second set of orifices, the third set of orifices arranged at a third orifice angle, where the third orifice angle is formed between the centerline of corresponding third set orifices and the vertical axis of the nozzle, where the third orifice angle is less than the second orifice angle and greater than the first orifice angle, and where the third set of orifices is part of the ring of orifices.

6. The fuel delivery system of claim 5, where the third set of orifices includes a first orifice group spaced away from a second orifice group, and where the first and second orifice groups are each arranged in an arc extending from the intake side of the nozzle to the exhaust side of the nozzle.

7. The fuel delivery system of claim 1, where the first set of orifices and the second set of orifices are each arranged in an arc about a central axis of the nozzle and have a common vertical position with regard to the vertical axis.

8. The fuel delivery system of claim 7, where each of the orifices in the first set of orifices and the second set of orifices are sequentially spaced apart at equivalent azimuthal angles measured about the central axis of the nozzle.

9. The fuel delivery system of claim 1, where a diameter of each of the orifices in the first and second sets of orifices is less than 85 microns.

10. The fuel delivery system of claim 1, where the orifices included in each of the first set of orifices and the second set of orifices have a slit shape with an arc section extending between a first end and a second end.

11. The fuel delivery system of claim 1, where the nozzle is positioned between an intake valve and an exhaust valve with regard to a horizontal axis.

12. A fuel delivery system, comprising:

a cylinder;

an exhaust valve coupled to the cylinder;

an intake valve coupled to the cylinder; and a direct fuel injector coupled to the cylinder, the direct fuel injector including:

a body receiving fuel from a fuel source; and a nozzle in fluidic communication with the body, the nozzle including:

a first set of orifices including a plurality of orifices, each of the plurality of orifices in the first set of orifices arranged at a first orifice angle, and the first set of orifices extending in an arc on an intake side of the nozzle; and a second set of orifices including a plurality of orifices, each of the plurality of orifices in the second set of orifices arranged at a second orifice angle on an exhaust side of the nozzle, the first orifice angle less than the second orifice angle, and the second set of orifices extending in an arc on the exhaust side of the nozzle;

where each of the first orifice angle and the second orifice angle is an angle formed between a centerline of a corresponding orifice and a vertical axis, where the vertical axis extends parallel to a z-axis and parallel to a central axis of the cylinder, where only one ring of orifices, including the first set of orifices and the second set of orifices, is positioned along a circumference of a central axis of the nozzle in an x-axis and y-axis plane of the nozzle, each of the orifices of the ring positioned at equivalent radii in the x-axis and y-axis plane, where each of the first orifice angle and the second orifice angle is an angle formed between a centerline of a corresponding orifice and the vertical axis of the nozzle, where the centerline of the corresponding orifice is perpendicular to an outer face plane of the corresponding orifice, where the first set of orifices is the only set located entirely on the intake side of the nozzle, and where the second set of orifices is the only set located entirely on the exhaust side of the nozzle.

13. The fuel delivery system of claim 12, further comprising a third set of orifices included in the ring, the third set of orifices positioned between the first set of orifices and the second set of orifices, and the third set of orifices arranged at a third orifice angle, where the third orifice angle is less than the second orifice angle and greater than the first orifice angle, and where the third orifice angle is formed between the centerline of corresponding third set orifices and the vertical axis of the nozzle.

14. The fuel delivery system of claim 12, where the first orifice angle is between 25 and 30 degrees and the second orifice angle is between 35 and 45 degrees.

15. The fuel delivery system of claim 12, where a diameter of each of the orifices in the first and second sets of orifices is less than 85 microns.

16. The fuel delivery system of claim 12, where the orifices included in each of the first set of orifices and the second set of orifices have a slit shape with an arc section extending between a first end and a second end.

17. The fuel delivery system of claim 12, where the direct fuel injector is positioned between the intake valve and the exhaust valve with regard to a horizontal axis.

18. A direct fuel injector, comprising:

a body receiving fuel from a fuel source; and a nozzle in fluidic communication with the body, the nozzle including:

a first set of orifices including a plurality of orifices, each of the plurality of orifices in the first set of orifices arranged at a first orifice angle, and the first set of orifices extending in an arc on an intake side of the nozzle;

a second set of orifices including a plurality of orifices, each of the plurality of orifices in the second set of orifices arranged at a second orifice angle, and the second set of orifices extending in an arc on an exhaust side of the nozzle, where the second orifice angle is greater than the first orifice angle; and a third set of orifices including a plurality of orifices, each of the plurality of orifices in the third set of orifices arranged at a third orifice angle, where the third orifice angle is less than the second orifice angle and greater than the first orifice angle;

where each of the first, second, and third orifice angles is an angle formed between a centerline of a corresponding orifice and a vertical axis, where the centerline of the corresponding orifice is perpendicular to an outer face plane of the corresponding orifice, where the vertical axis extends parallel to a z-axis, where only one ring of orifices, including the first set of orifices, the second set of orifices, and the third set of orifices, circumferentially surrounds a central axis of the nozzle in an x-axis and y-axis plane of the nozzle, where each of the orifices of the ring are positioned at equivalent radii in the x-axis and y-axis plane, where the first set of orifices is the only set located entirely on the intake side of the nozzle, and where the second set of orifices is the only set located entirely on the exhaust side of the nozzle.

19. The direct fuel injector of claim 18, where orifices in the third set of orifices extend from the intake side of the nozzle to the exhaust side of the nozzle.

20. The direct fuel injector of claim 18, where the first orifice angle is between 25 and 30 degrees, the second orifice angle is between 35 and 45 degrees, and the third orifice angle is between 30 and 35 degrees.

* * * * *